US010595589B2

(12) United States Patent
Hedström

(10) Patent No.: US 10,595,589 B2
(45) Date of Patent: Mar. 24, 2020

(54) INSOLE FOR HIGH-HEELED FOOTWEAR

(71) Applicant: STINAA & J FASHION AB, Stockholm (SE)

(72) Inventor: Peter Hedström, Umeå (SE)

(73) Assignee: STINAA & J FASHION AB, Stockholm (SE)

( * ) Notice: Subject to any disclaimer, the term of this patent is extended or adjusted under 35 U.S.C. 154(b) by 36 days.

(21) Appl. No.: 15/767,758

(22) PCT Filed: Sep. 13, 2016

(86) PCT No.: PCT/SE2016/050852
§ 371 (c)(1),
(2) Date: Apr. 12, 2018

(87) PCT Pub. No.: WO2017/065669
PCT Pub. Date: Apr. 20, 2017

(65) Prior Publication Data

US 2018/0295937 A1 Oct. 18, 2018

(30) Foreign Application Priority Data

Oct. 13, 2015 (SE) ..... 1551319

(51) Int. Cl.

| | |
|---|---|
| ***A43B 7/22*** | (2006.01) |
| ***A43B 17/02*** | (2006.01) |
| ***A43B 7/14*** | (2006.01) |
| ***A43B 13/18*** | (2006.01) |
| ***A43B 17/14*** | (2006.01) |

(52) U.S. Cl.
CPC ..... *A43B 17/02* (2013.01); *A43B 7/145* (2013.01); *A43B 7/1445* (2013.01); *A43B 13/186* (2013.01); *A43B 17/023* (2013.01); *A43B 17/14* (2013.01)

(58) Field of Classification Search
CPC ..... A43B 17/02; A43B 17/00; A43B 7/1445; A43B 7/145; A43B 7/32
USPC ..... 36/9, 81, 82
See application file for complete search history.

(56) References Cited

U.S. PATENT DOCUMENTS

| | | | | |
|---|---|---|---|---|
| 1,841,942 A | | 1/1932 | Fenton | |
| 2,097,476 A | | 11/1937 | Silver | |
| 2,217,882 A | * | 10/1940 | Andersen | A43B 7/14 36/178 |
| 2,327,361 A | | 8/1943 | Margolin | |
| 2,411,901 A | | 12/1946 | Silver | |

(Continued)

FOREIGN PATENT DOCUMENTS

| | | |
|---|---|---|
| FR | 2678810 A1 | 1/1993 |
| SE | 94252 | 1/1939 |
| WO | WO 2015/056958 A1 | 4/2015 |

OTHER PUBLICATIONS

Office Action for corresponding Canadian Application No. 3,001,663 dated Apr. 9, 2019.

(Continued)

*Primary Examiner* — Timothy K Trieu
(74) *Attorney, Agent, or Firm* — Renner, Otto, Boisselle & Sklar, LLP

(57) ABSTRACT

Insole (28) for high-heeled footwear (26), wherein the insole (28) comprises a lifting structure (34) arranged to lift the metatarsal heads (24) and to flatten the angles of the metatarsal phalangeal joints (22).

12 Claims, 3 Drawing Sheets

(56) References Cited

U.S. PATENT DOCUMENTS

| | | | | |
|---|---|---|---|---|
| 2,755,569 | A * | 7/1956 | Guy | A43B 7/141<br>36/178 |
| 4,813,157 | A * | 3/1989 | Boisvert | A43B 7/142<br>36/145 |
| 7,082,704 | B2 * | 8/2006 | Throneburg | A43B 7/16<br>36/25 R |
| 7,266,910 | B2 * | 9/2007 | Ingimundarson | A43B 13/026<br>36/178 |
| 2009/0007455 | A1 | 1/2009 | Montgomery | |
| 2009/0193683 | A1 * | 8/2009 | Igdari | A43B 7/142<br>36/91 |
| 2010/0251568 | A1 | 10/2010 | Haruda | |

OTHER PUBLICATIONS

International Preliminary Report on Patentability for related International Application No. PCT/SE2016/050852 dated Apr. 17, 2018.
International Search Report for related International Application No. PCT/SE2016/050852 dated Nov. 18, 2016.

* cited by examiner

INSOLE FOR HIGH-HEELED FOOTWEAR

TECHNICAL FIELD

The present disclosure generally relates to an insole for high-heeled footwear. In particular, an insole and a high-heeled footwear, such as a high-heeled shoe, comprising the insole are provided.

BACKGROUND

Conventional high-heeled shoes are often uncomfortable and painful to wear while standing and walking. The position of the foot in the high-heeled shoe imposes a high load on the forefoot. High-heeled shoes also require an unnatural walking style. This often leads to various types of injuries.

Injuries resulting from wearing high-heeled shoes may include Morton's syndrome where a shortened first metatarsal results in excessive force on the metatarsal head of the second metatarsal; metatarsalgia where the metatarsals become irritated and inflamed due to an uneven weight distribution across the foot when it hits the road; Hallux valgus where the big toe points toward the second toe, resulting in a protrusion at the metatarsal phalangeal joint of the first metatarsal; a stress fracture which is a small crack in a bone, or a severe bruising within a bone, typically caused by overuse and repetitive activity; and sesamoiditis where the sesamoids break or the tendons surrounding the sesamoids become irritated or inflamed.

US 2010/0251568 A1 discloses a footwear insert to reduce pain or discomfort for a user of shoes where the heel is raised higher than that of the natural foot angle. The footwear insert comprises a metatarsal portion configured to transfer a brace force to a metatarsal edge of a foot to reduce a tendency of the foot to move toward a front portion of the footwear.

SUMMARY

One object of the present disclosure is to provide an insole for high-heeled footwear that increases the comfort of the wearer and reduces the risk for injuries.

According to one aspect, an insole for high-heeled footwear is provided, wherein the insole comprises a lifting structure arranged to lift the metatarsal heads and to flatten the angles of the metatarsal phalangeal joints. With the lifting structure, the metatarsal heads can be lifted from a position where the metatarsal heads would have been positioned in a footwear with an insole having a uniform thickness. The direction of the lift may include a vertical component (i.e. perpendicular to a horizontal plane on which the footwear is placed). Thus, the lift of the metatarsal heads by the lifting structure may or may not be in a vertical direction only (when the insole is arranged in the footwear and the footwear is placed on a horizontal plane).

Furthermore, by flattening the angles of the metatarsal phalangeal joints is meant that the lifting structure is arranged to flatten (i.e. make more flat) the angles in comparison with the angles of the metatarsal phalangeal joints of a foot placed in a footwear having an insole with a uniform thickness.

The metatarsal phalangeal joints are the respective joints between the metatarsals and the proximal phalanges in the foot. The metatarsal heads are the ends of the metatarsals closest to the proximal phalanges. Conventional high-heeled shoes often position the foot with rather sharp angles in the metatarsal phalangeal joints. This includes the footwear with an insert according to US 2010/0251568 A1 where the metatarsal portion actually increases (i.e. makes more acute) the angle between the metatarsals and the proximal phalanges. However, by lifting the metatarsal heads and by flattening the angles of the metatarsal phalangeal joints, i.e. by flattening the angles between the metatarsals and the proximal phalanges, the load imposed on the forefoot can be reduced by moving this load (or a at least a part of this load) back on the foot. This reduces the load imposed on the joints of the feet and consequently also reduces the risk for injuries.

Moreover, by lifting the metatarsal heads and by flattening the angles of the metatarsal phalangeal joints, the wearer of the high-heeled shoes is given a push forward when walking or moving. Thus, the lifting structure of the insole contributes to a better rolling of the foot when walking in comparison with conventional high-heeled shoes having an insole of uniform thickness.

Throughout the present disclosure, the lifting structure may alternatively be referred to as a bar. The lifting structure or bar may be positioned at a distance from a front edge of the insole that is 20-40%, such as 25-35%, such as 28-32 Ws, of the entire length of the insole, as seen in a longitudinal direction of the insole.

The lifting structure may be constituted by an elevated bar or local thickened segment extending substantially transverse to the longitudinal direction of the insole. Naturally, the longitudinal direction of the insole is coincident or parallel with a longitudinal direction of the footwear, i.e. the forward walking direction. The lifting structure may protrude from an upper side, a lower side, or both, of the insole.

As an alternative to an elevated bar, the lifting structure may be constituted by a section of harder material than the regions of the insole adjacent to the lifting structure. With this configuration, the insole has a substantially uniform thickness around the lifting structure in an unloaded state of the insole. However, when a foot is placed on the insole, the section of harder material is compressed less than the regions of the insole adjacent to the lifting structure.

According to one variant, the lifting structure may be substantially arc-shaped. The arc-shaped lifting structure may have an arc shape substantially parallel with the surfaces of the insole adjacent to the lifting structure. The arc shape may not be perfectly circular but may conform to a line interconnecting, or substantially interconnecting, the metatarsal phalangeal joints of the foot. The concave side of the arc-shaped lifting structure may be directed towards a heel region of the insole (or towards a heel region of the footwear in case the insole is constituted by a partial insole).

The lifting structure may have a decreasing thickness in a direction towards a toe region of the footwear. For example, the lifting structure may be substantially wedge-shaped (as seen from the side of the insole) or may comprise at least two steps. Thus, the lifting structure may comprise at least two sections with decreasing thickness in a direction towards a toe region of the footwear. The at least two sections may be joined or separated in the longitudinal direction of the insole.

According to one variant, the lifting structure comprises three sections with decreasing elevations towards the toe region of the footwear. For example, the three sections may be elevated 5-7 mm, such as 6 mm, 3-5 mm, such as 4 mm, and 1-3 mm, such as 2 mm, respectively, with respect to a surface of the insole adjacent to the lifting structure. As an alternative, the three sections may be elevated or raised 2.5-3.5 mm, 1.5-2.5 mm and 0.5-1.5 mm, respectively, with respect to both the upper surface and the lower surface of the insole adjacent to the lifting structure.

In case the lifting structure is implemented with at least two sections with decreasing thickness in a direction towards a toe region of the footwear, the rearmost section of the lifting structure may be wider than the foremost section of the lifting structure (the width direction of the insole is a direction substantially perpendicular to a longitudinal direction of the insole). For example, the rearmost section of the lifting structure may extend over the entire width, or over substantially the entire width, of the insole. The foremost section of the lifting structure may be centrally positioned along the width direction of the insole and may have a mean width occupying 30-80%, such as 50-60 Ws, of the width of the insole. If more than two sections with decreasing thickness are implemented, the width of the one or more intermediate sections may increase substantially linearly between the width of the foremost section and the width of the rearmost section.

The lifting structure may be integrally formed with the regions of the insole adjacent to the lifting structure. The lifting structure may be formed of the same material as the remainder of, or a substantial part of, the insole. Alternatively, the lifting structure may be formed of a material different from the remainder of, or a substantial part of, the insole. For example, the lifting structure may be attached to the upper and/or lower surface of the insole in a different processing step or by a retrofitting of an insole.

The lifting structure may be formed of a shock absorbing material. One suitable material for the lifting structure is PORON®. The insole may be flexible and may have a substantially flat appearance when unloaded. Alternatively, the insole may be substantially rigid and have a form substantially conforming to the interior of the footwear in an unloaded state.

The insole may be a partial insole. Such partial insole may be constituted by a forefoot insert. In case the insole is constituted by a partial insole, the lifting structure may be positioned at a distance from a front edge of the inside of the footwear that is 20-40 Ws, such as 25-35 Ws, such as 28-32 Ws, of the entire length of the inside of the footwear, as seen in a longitudinal direction of the footwear.

According to a further aspect, there is provided a high-heeled footwear, such as a high-heeled shoe, comprising an insole according to the present disclosure. The heel of the high-heeled shoe may be 8-14 cm. The insole may be a built-in insole, i.e. the insole may be integrally formed with the footwear.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
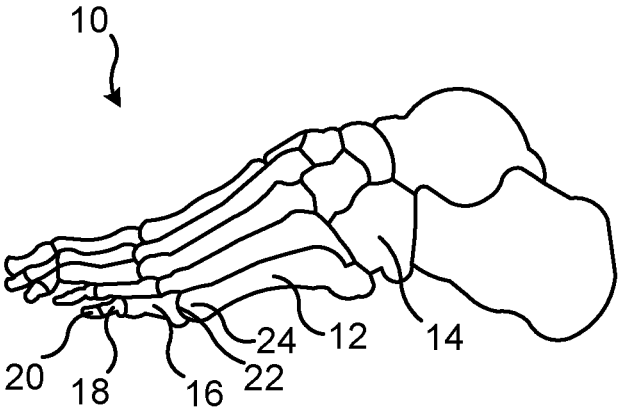
FIG. 1: schematically represents a side view of bones in a foot.

In the following, an insole and a high-heeled footwear, such as a high-heeled shoe, comprising the insole will be described. The same reference numerals will be used to denote the same or similar structural features.

FIG. 1 schematically represents a side view of bones in a foot 10. The foot 10 comprises five metatarsals or metatarsal bones 12 located between the tarsal bones 14 and the phalanges. The phalanges are the bones in the toes and each toe except the large toe comprises a proximal phalange 16, an intermediate phalange 18 and a distal phalange 20. The large toe only has two phalanges. A metatarsal phalangeal joint 22 joins each metatarsal 12 to a respective proximal phalange 16. The metatarsal heads 24 are the ends of the metatarsals 12 closest to the proximal phalanges 16.

Figure 2:
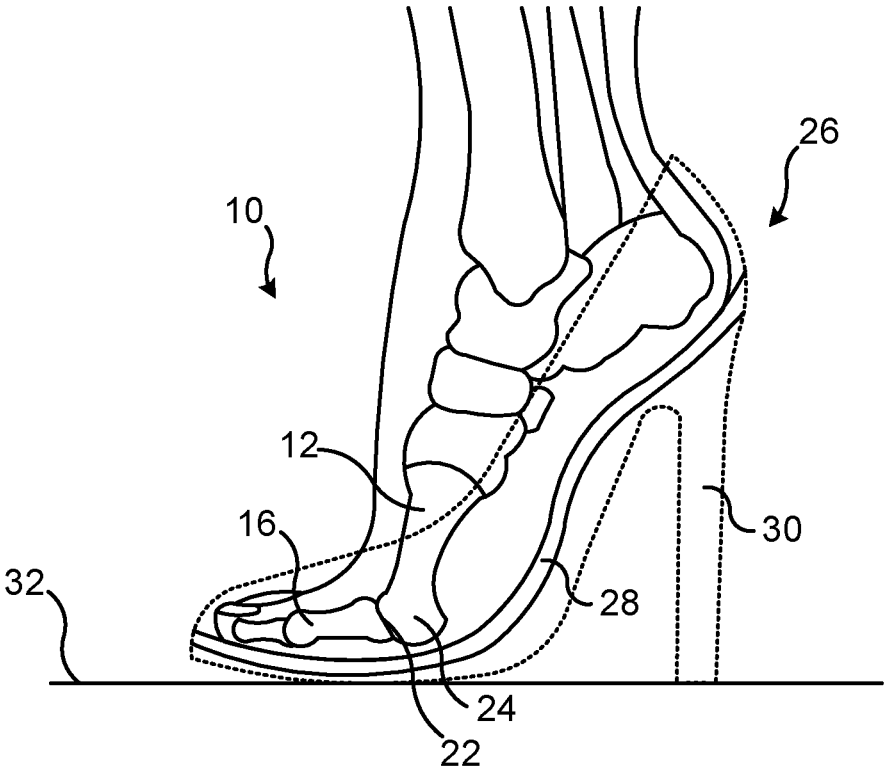
FIG. 2: schematically represents a side view of a high-heeled shoe with an insole having uniform thickness.

FIG. 2 schematically represents a side view of a high-heeled shoe 26 with an insole 28 having uniform thickness. The shoe 26 comprises a heel 30 of approximately 12 cm. As can be seen in FIG. 2, the shoe 26 positions the foot 10 with a sharp angle between the metatarsals 12 and the proximal phalanges 16. The proximal phalanges 16 are oriented substantially parallel with a horizontal plane 32 and the metatarsals 12 are angled approximately 80° with respect to the horizontal plane 32. As a consequence, a high load is imposed on the forefoot and the wearer risks to be injured. Moreover, this high-heeled footwear 26 requires an unnatural walking style.

Figure 3A:
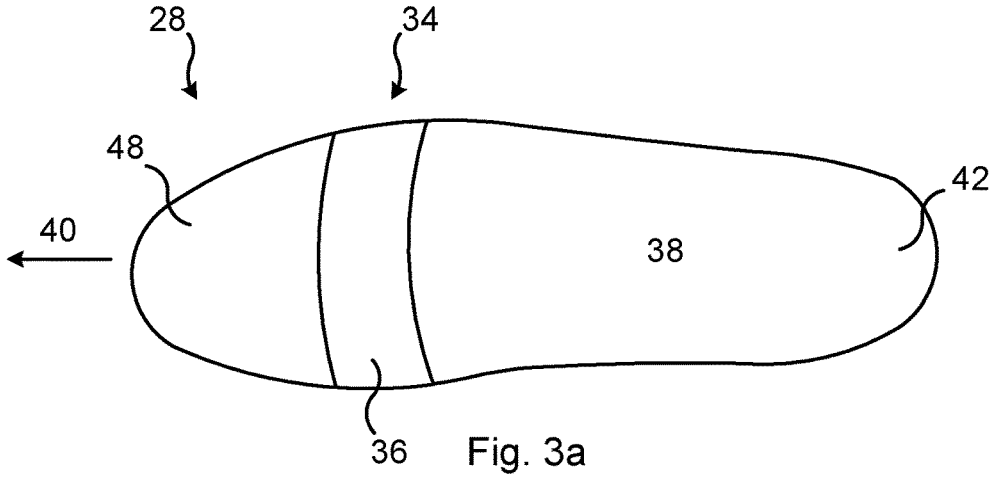
FIG. 3*a*: schematically represents a top view of an insole having a lifting structure.
Figure 3B:
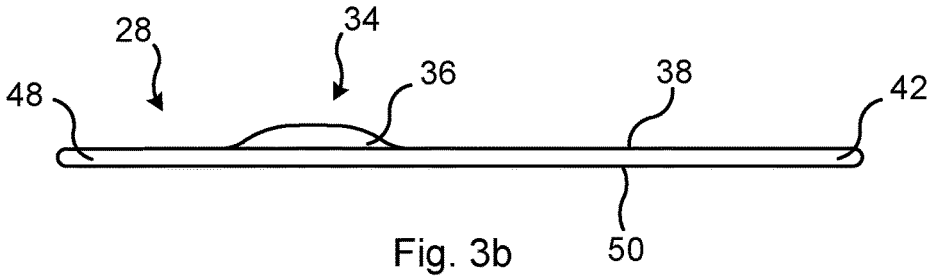
FIG. 3*b*: schematically represents a side view of the insole in FIG. 3*a;*

FIG. 3*a* schematically represents a top view of an insole 28 for high-heeled footwear 26 having a lifting structure 34 and FIG. 3*b* schematically represents a side view of the insole 28 in FIG. 3*a*. The lifting structure 34 is arranged to lift the metatarsal heads 24 from the position as illustrated in FIG. 2 and to flatten the angles of the metatarsal phalangeal joints 22, i.e. the angles between the respective metatarsals 12 and proximal phalanges 16.

The insole 28 in FIGS. 3*a* and 3*b* is flexible and has a substantially uniform thickness in the regions outside the lifting structure 34. As can be seen in FIG. 3*b*, the lifting structure 34 comprises a raised section 36 of the shock absorbing material PORON® attached to an upper surface 38 of the insole 28. However, the lifting structure 34 may alternatively be produced integrally with the insole 28. Other shock absorbing materials than PORON® are also conceivable.

The lifting structure 34 is positioned at a distance from a front edge (i.e. the left end in FIGS. 3*a* and 3*b*) that is approximately 30% of the entire length of the insole 28, as seen in a longitudinal direction 40 of the insole 28. The longitudinal direction 40 constitutes the forward walking direction when the insole 28 is arranged in a footwear 26.

The lifting structure 34 is constituted by an elevated bar extending substantially transverse to the longitudinal direction 40 of the insole 28. In FIGS. 3*a* and 3*b*, the lifting structure 34 protrudes from the upper surface 38 of the insole 28.

Furthermore, the lifting structure 34 is substantially arc-shaped. The arc shape is substantially parallel with the upper surface 38 of the insole 28 adjacent to the lifting structure 34 and the concave side of the arc faces a heel region 42 of the insole 28. The arc-shape of the lifting structure 34 is designed and placed to substantially conform to a line interconnecting the metatarsal phalangeal joints 22 of the foot 10.

Figure 4A:
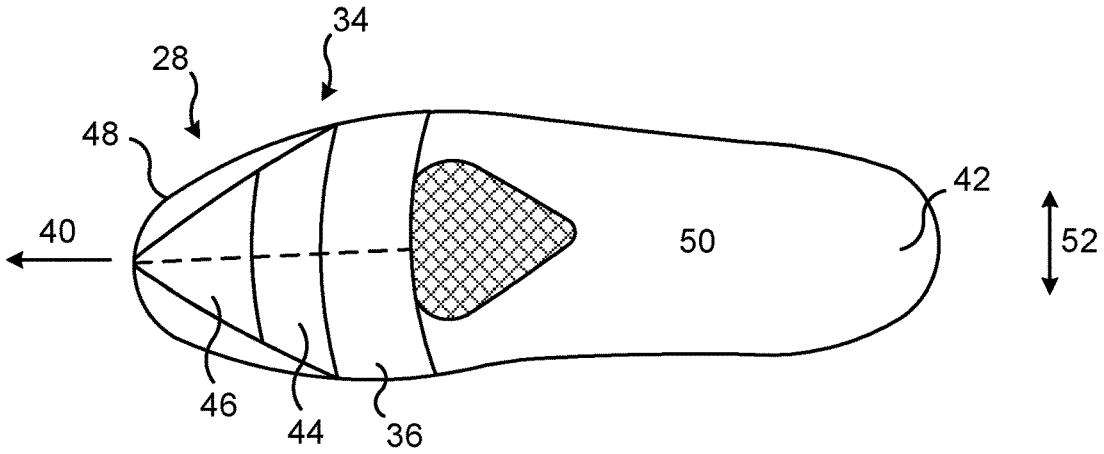
FIG. 4*a*: schematically represents a bottom view of another insole having a lifting structure.
Figure 4B:
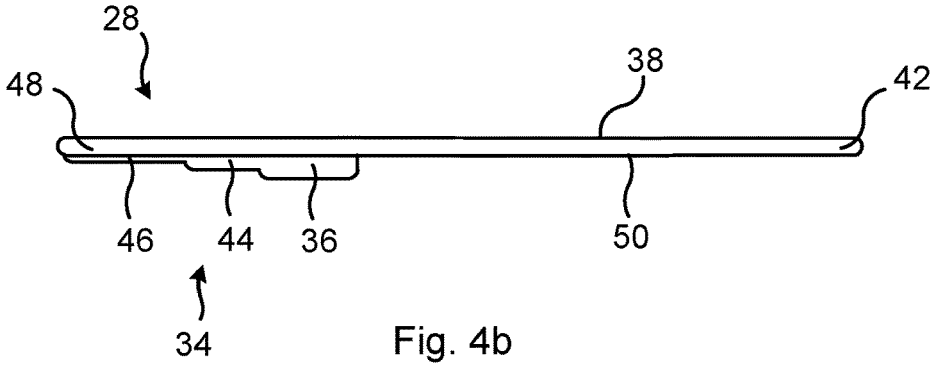
FIG. 4*b*: schematically represents a side view of the insole in FIG. 4*a*.

FIG. 4*a* schematically represents a bottom view of another insole 28 having a lifting structure 34 and FIG. 4*b* schematically represents a side view of the insole 28 in FIG. 4*a*. Mainly differences with respect to FIGS. 3*a* and 3*b* will be described.

The lifting structure 34 in FIGS. 4*a* and 4*b* comprises three sections 36, 44, 46 next to each other and having decreasing elevations towards a toe region 48 of the insole 28. The lifting structure 34 thereby forms three steps. Each section 36, 44, 46 protrudes from a lower surface 50 of the insole 28. The rearmost section 36 is substantially identical to the raised section 36 in FIGS. 3*a* and 3*b*. The rearmost section 36 is protruded or elevated 6 mm, the middle section 44 is elevated 4 mm and the foremost section 46 is elevated 2 mm from the lower surface 50 of the insole 28.

As can be seen in FIG. 4*b*, the three sections 36, 44, 46 are attached to the lower surface 50 of the insole 28. However, also this lifting structure 34 may alternatively be produced integrally with the insole 28.

As can be seen in FIG. 4*a*, the rearmost section 36 is wider than the foremost section 46 of the lifting structure 34. The middle section 44 has a width lying between the widths of the rearmost section 36 and the foremost section 46. Here, the width direction 52 is directed perpendicular to the longitudinal direction 40 of the insole 28.

The rearmost section 36 of the lifting structure 34 conforms to the local width (i.e. the width of the insole 28 where the rearmost section 36 is positioned) and is substantially flush with the outer periphery of the insole 28. As can be seen in FIG. 4*a*, the middle section 44 and the foremost section 46 together form a triangle and the width of the middle section 44 and the foremost section 46 linearly decreases from a full width next to the rearmost section 36 to a single point at the front edge of the insole 28. That is, the middle section 44 substantially forms a parallelepiped shaped segment of the triangle and the foremost section 46 forms a triangle. The mean width of the foremost section 46 is approximately 50% of the local width of the insole 28.

Figure 5:
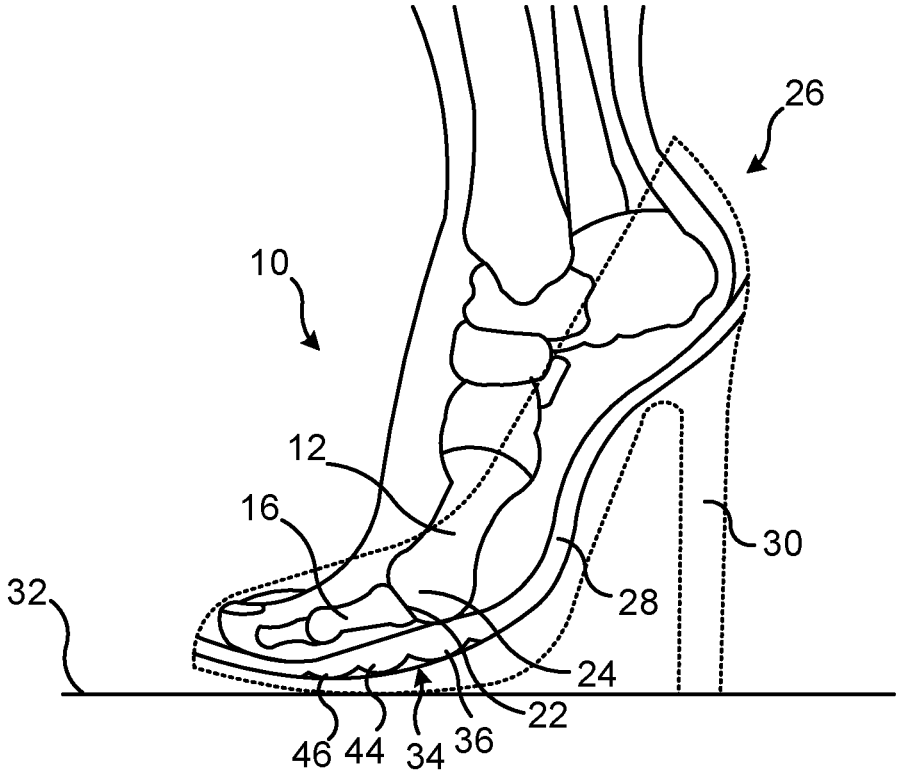
FIG. 5: schematically represents a side view of a high-heeled footwear with the insole of FIGS. 4*a* and 4*b*.

FIG. 5 schematically represents a side view of the high-heeled footwear 26 in FIG. 2 but with the insole 28 of FIGS. 4*a* and 4*b*. As can be seen in FIG. 5, the lifting structure 34, in particular the rearmost section 36 of the lifting structure 34, lifts the metatarsal heads 24 substantially vertically. Thus, the metatarsal heads 24 are positioned higher within the footwear 26 than with the insole 28 of uniform thickness in FIG. 2.

Furthermore, FIG. 5 illustrates that the insole 28 with the lifting structure 34 rotates the proximal phalanges 16 in a counter-clockwise direction and rotates the metatarsals 12 in a clockwise direction (as seen in FIG. 5). In other words, the proximal phalanges 16 are more inclined with 3*o* respect to the horizontal plane 32 and the metatarsals 12 are less inclined with respect to the horizontal plane 32 in comparison with the position of the foot 10 in FIG. 2. Thereby, the angles of the metatarsal phalangeal joints 22 are flattened and the load imposed on the forefoot can be reduced by moving this load (or a at least a part of this load) back on the foot 10.

The lifting structure 34 further enables a better rolling of the foot 10 with the high-heeled footwear 26. That is, the wearer of the high-heeled shoes 26 is given a push forward when walking or moving. This rolling effect is further improved by the lifting structure 34 (here implemented with the three sections 36, 44, 46) having a decreasing thickness in a direction towards a toe region 48 of the footwear 26.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

The invention claimed is:

1. Insole for high-heeled footwear, wherein the insole comprises a lifting structure that upon insertion into the high-heeled footwear is arranged to lift the metatarsal heads and to flatten the angles of the metatarsal phalangeal joints of a foot of a wearer; and wherein the lifting structure comprises three sections with decreasing thickness in a direction towards a toe region of the footwear, the three sections comprising a rearmost section furthest from the toe region, a foremost section, and a middle section between the rearmost section and the foremost section;

wherein the rearmost section, the foremost section, and the middle section respectively protrude from a lower surface of the insole or from an upper surface of the insole; and wherein the foremost section is elevated 1-3 mm with respect to the lower surface or the upper surface of the insole from which the foremost section protrudes, the middle section is elevated 3-5 mm with respect to the lower surface or the upper surface of the insole from which the middle section protrudes, and the rearmost section is elevated 5-7 mm with respect to the lower surface or the upper surface of the insole from which the rearmost section protrudes; or wherein the foremost section is elevated 0.5-1.5 mm with respect to the lower surface or the upper surface of the insole from which the foremost section protrudes, the middle section is elevated 1.5-2.5 mm with respect to the lower surface or the upper surface of the insole from which the middle section protrudes, and the rearmost section is elevated 2.5-3.5 mm with respect to the lower surface or the upper surface of the insole from which the rearmost section protrudes.

2. The insole according to claim 1, wherein the lifting structure is constituted by an elevated bar extending substantially transverse to a longitudinal direction of the insole.

3. The insole according to claim 1, wherein the lifting structure is arc-shaped and a concave side of the arc-shaped lifting structure faces a heel region of the insole.

4. The insole according to claim 1, wherein the lifting structure is integrally formed with regions of the insole adjacent to the lifting structure.

5. The insole according to claim 1, wherein the insole is a partial insole.

6. The insole according to claim 1, wherein a rearmost section of the three sections of the lifting structure is wider than a foremost section of the three sections of the lifting structure.

7. The insole according to claim 6, wherein the rearmost section extends over substantially the entire width of the insole.

8. The insole according to claim 6, wherein the foremost section is centrally positioned along a width direction of the insole and has a mean width occupying 30-80% of the width of the insole.

9. The insole according to claim 6, wherein a middle section and the foremost section of the three sections of the lifting structure together form a triangle and the width of the middle section and the foremost section linearly decreases from a full width next to the rearmost section to a single point at a front edge of the insole.

10. The insole according to claim 1, wherein the lifting structure is made of a shock absorbing material.

11. High-heeled footwear, comprising an insole:

wherein the insole comprises a lifting structure arranged to lift the metatarsal heads and to flatten the angles of the metatarsal phalangeal joints of a foot of a wearer; and wherein the lifting structure comprises three sections with decreasing thickness in a direction towards a toe region of the footwear, the three sections comprising a rearmost section furthest from the toe region, a foremost section, and a middle section between the rearmost section and the foremost section;

wherein the rearmost section, the foremost section, and the middle section respectively protrude from a lower surface of the insole or from an upper surface of the insole; and wherein the foremost section is elevated 1-3 mm with respect to the lower surface or the upper surface of the insole from which the foremost section protrudes, the middle section is elevated 3-5 mm with respect to the lower surface or the upper surface of the insole from which the middle section protrudes, and the rearmost section is elevated 5-7 mm with respect to the lower surface or the upper surface of the insole from which the rearmost section protrudes; or wherein the foremost section is elevated 0.5-1.5 mm with respect to the lower surface or the upper surface of the insole from which the foremost section protrudes, the middle section is elevated 1.5-2.5 mm with respect to the lower surface or the upper surface of the insole from which the middle section protrudes, and the rearmost section is elevated 2.5-3.5 mm with respect to the lower surface or the upper surface of the insole from which the rearmost section protrudes.

12. The high-heeled footwear according to claim 11, wherein the insole is a built-in insole.

* * * * *